US005705631A

United States Patent [19]

Malcolm

[11] Patent Number: 5,705,631

[45] Date of Patent: Jan. 6, 1998

[54] LAMINAR FLOW PROCESS OF PREPARING CELLULOSE DIACETATE FIBERS

[75] Inventor: Michael Orlando Malcolm, Kingsport, Tenn.

[73] Assignee: Eastman Chemical Company, Kingsport, Tenn.

[21] Appl. No.: 572,910

[22] Filed: Dec. 15, 1995

[51] Int. Cl.[6] ..... C08B 3/56

[52] U.S. Cl. ..... 536/69; 264/45.8; 264/45.9; 264/200; 536/76

[58] Field of Search ..... 264/45.8, 45.9, 264/200; 536/30, 76; 521/138, 282

[56] References Cited

U.S. PATENT DOCUMENTS

| | | |
|---|---|---|
| 1,456,781 | 5/1923 | Kessler et al. . |
| 2,239,782 | 4/1941 | Haney et al. . |
| 2,287,897 | 6/1942 | Martin . |
| 2,632,686 | 3/1953 | Bashford et al. . |
| 4,192,838 | 3/1980 | Keith et al. . |
| 4,228,276 | 10/1980 | Chung-Ming et al. . |

FOREIGN PATENT DOCUMENTS

| | | |
|---|---|---|
| 0 711 512 A2 | 5/1996 | European Pat. Off. . |
| 790039 | 2/1956 | United Kingdom . |
| 992740 | 5/1965 | United Kingdom . |

OTHER PUBLICATIONS

Gedon et al, "Cellulose Ester, Organic", *Kirk–Othmer Encyclopedia of Chemical Technology*, 5, p. 510 & 520–524 (1993).

N. Eastman et al, "Cellulose Acetate and Triacetate Fibers", *Kirk–Othmer Encyclopedia of Chemical Technology*, 3, 5, pp. 105–108 (1979).

*Primary Examiner*—Duc Truong

*Attorney, Agent, or Firm*—Charles R. Martin; Harry J. Gwinnell

[57] ABSTRACT

A laminar flow process for preparing cellulose diacetate fibers is disclosed. In the process, a precipitation-acid stream and an acid-dope stream are contacted in a zone having substantially laminar flow. The acid-dope stream is annularly disposed within and flows in the same direction as the precipitation-acid stream. The precipitation-acid stream has a temperature of 100° to 200° F. and comprises 25 to 35 percent by weight acetic acid and 75 to 65 percent by weight water. The acid-dope stream has a temperature in the range of 100° to 200° F. and comprised of 5 to 22 weight percent of cellulose diacetate having an inherent viscosity of at least 1.0, and 95 to 78 percent by weight of a mixture comprising 65 to 90 weight percent acetic acid and 35 to 10 weight percent water. The precipitation-acid stream has a linear flow greater than or equal to the linear flow of the acid-dope stream. The weight ratio of the precipitation-acid stream to the acid-dope stream is at least 9:1. Contacting the two streams in this manner causes precipitation of cellulose diacetate fibers of predictable diameter as the two streams diffuse together.

4 Claims, 3 Drawing Sheets

LAMINAR FLOW PROCESS OF PREPARING CELLULOSE DIACETATE FIBERS

FIELD OF THE INVENTION

The present invention relates to a process for preparing cellulose diacetate fibers. More particularly, the invention relates to a laminar flow process to prepare small diameter cellulose diacetate fibers directly from acetic acid dope. The fibers may be used as filter tow or incorporated into paper products.

BACKGROUND OF THE INVENTION

The isolation of cellulose diacetate from organic solvent solutions is an old and well described art. The process for preparing cellulose diacetate from cellulose, with its acetylation and hydrolysis steps, results in a solution of the diacetate in an acetic acid and water mixture. Various techniques for isolating the cellulose diacetate from that solution have resulted in cellulose diacetate products in the form of powders, pellets, or flakes. See, for example, S. Gedon, R. Fengl, "Cellulose Ester, Organic", Kirk-Othmer Encyclopedia of Chemical Technology", 5th Edition, Volume 5, p.510 (1993), John Wiley & Sons, Inc. For various intermediate and end uses, the cellulose diacetate products are generally dissolved in volatile organic solvents such as acetone and methyl ethyl ketone. The solutions can be placed on objects so that when the solvent evaporates, a thin film or coating of cellulose diacetate remains on the object. Very concentrated solutions can be cast such that when the solvent evaporates, clear cellulose diacetate sheets are the product (ibid, p. 520–524). Forcing the concentrated cellulose diacetate solutions through spinnerette holes will result in a continuous fiber product. See N. Eastman, et. al., "Cellulose Acetate and Triacetate Fibers", Kirk-Othmer Encyclopedia of Chemical Technology", 3rd Edition, Vol. 5, p. 105–108 (1979), John Wiley and Sons, Inc.). The fibers resulting from this spinning process are, in general, very long, regular, and dense fibers. The fibers have a relatively constant diameter without kinks or curls in the fiber.

Attempts have been made to manufacture cellulose diacetate fibers (often referred to as secondary cellulose acetate fibers) from the acetic acid dope and/or without the use of such spinning technology. Basford and Doubleday in U.S. Pat. No. 2,632,686 disclose a process for wet spinning secondary cellulose acetate fibers from an acid dope and a process that will manufacture acetate films. The dope is extruded through a jet into an aqueous coagulating bath containing at least one metal salt as the coagulant medium. The examples in this patent show that the dope must be filtered and then deaerated for 6 hours before use. The fibers were made using 0.002 in. diameter spinnerettes. British Patent No. 790,039 describes a precipitation process in which the cellulose diacetate-containing acid dope is extruded through apertures. The continuous filaments formed this way are allowed to fall freely through the air for a short distance before they enter a hardening liquid. The filaments are allowed to fall through the liquid until they harden at least to the point where they will not coalesce or cohere on simple contact, then are deposited on a moving belt and carried to a cutter.

U.S. Pat. No. 1,456,781 to Kessler and Sease discloses a "Process of Recovering Cellulose Acetate from Solutions Thereof." The process comprises forcing an acetic acid solution of cellulose acetate through a filter screen and then through small orifices into a liquid capable of precipitating cellulose acetate in the form of an irregular mass of filaments.

U.S. Pat. No. 2,239,782 to Haney and U.S. Pat. No. 2,287,897 to Martin disclose similar processes for the production of cellulose diacetate fibers from acid dope. The equipment described to effect this production involves something similar to a horizontal continuous precipitator with the dope being moved form compartment to compartment while being diluted with precipitation liquids until the ester is precipitated as a fiber.

U.S. Pat. No. 4,192,838 to Keith and Tucker describes the preparation of highly fibrillated cellulose acetate fiber. A supply of cellulose acetate is dissolved in acetone or acetic acid and pumped through a capillary tube whose end is situated in the throat of a venturi tube. A coagulation liquid, usually hot or cold water, is passed through the venturi tube. The high velocity of the water stream in the throat of the venturi tube serves to attenuate the dope stream and additionally extracts the dope solvent, thereby forming a fibrette.

Despite such attempts to manufacture cellulose diacetate fibers the acetic acid dope, a need remains for an economical and efficient process for making cellulose diacetate fibers. More importantly, a need exists for a process of manufacturing cellulose diacetate fibers suitable for use in papermaking and other applications. The fibers should be prepared directly from the cellulose diacetate-containing acid dope resulting from a typical cellulose acetylation and hydrolysis process.

SUMMARY OF THE INVENTION

The present invention relates to a process for preparing cellulose diacetate fibers and answers the need for an economical and efficient process. In the process of the invention, a precipitation-acid stream and a acid-dope stream are contacted in a zone having substantially laminar flow. The acid-dope stream is annularly disposed within and flows in the same direction as the precipitation-acid stream. The precipitation-acid stream has a temperature of 100° to 200° F. and comprises 25 to 35 percent by weight acetic acid and 75 to 65 percent by weight water. The acid-dope stream has a temperature in the range of 100° to 200° F. and comprised of 5 to 22 weight percent of cellulose diacetate having an inherent viscosity of at least 1.0, and 95 to 78 percent by weight of a mixture comprising 65 to 90 weight percent acetic acid and 35 to 10 weight percent water. The precipitation-acid stream has a linear flow greater than or equal to the linear flow of the acid-dope stream. The weight ratio of the precipitation-acid stream to the acid--dope stream is at least 9:1. Contacting the two streams in this manner causes small diameter cellulose diacetate fibers to precipitate as the two streams diffuse together.

DETAILED DESCRIPTION OF THE INVENTION

Figure 1:
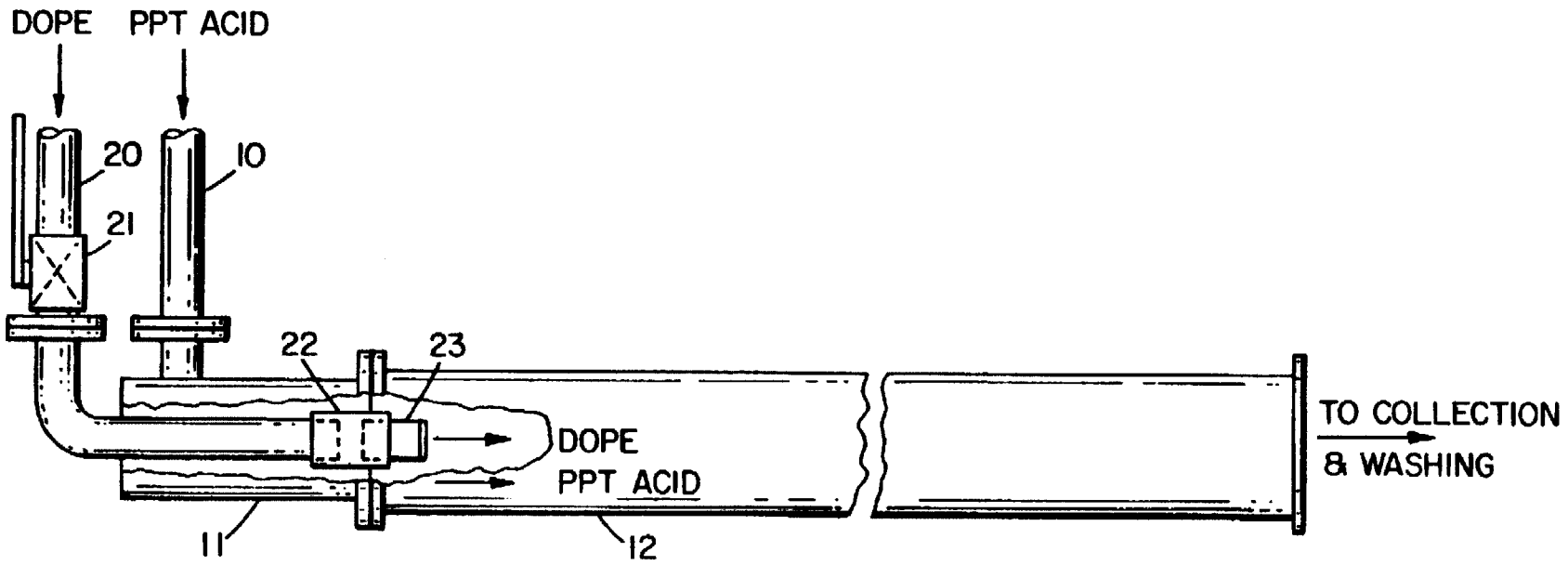
FIG. 1 depicts an apparatus for carrying out a laminar flow process to prepare cellulose diacetate fibers according to the invention.
Figure 2A:
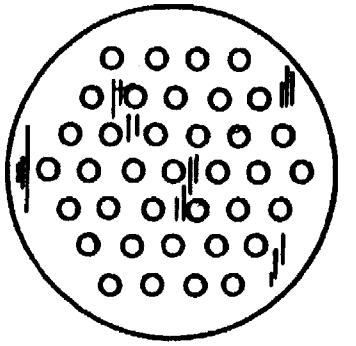
FIG. 2 depicts various extrusion dies useful in extruding the acid-dope stream in a process of the invention.
Figure 2B:
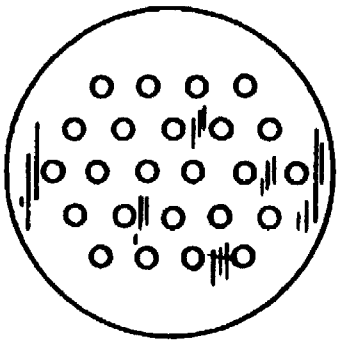
Figure 2C:
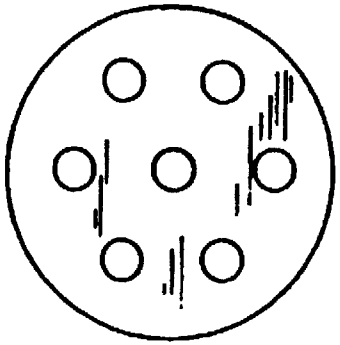
Figure 2D:
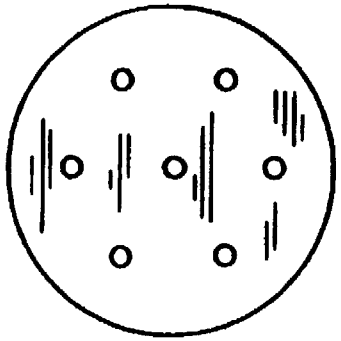
Figure 2E:
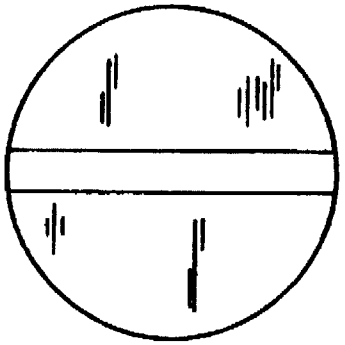
Figure 2F:
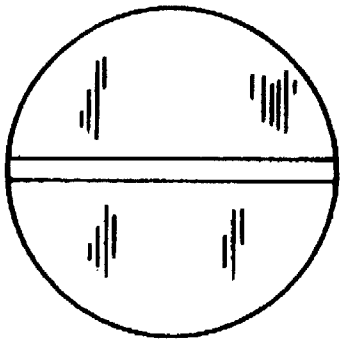
Figure 2G:
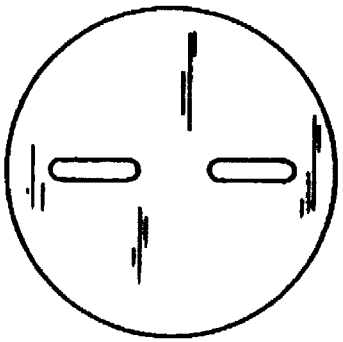

The present invention relates to a process for preparing cellulose diacetate fibers. The process yields fibers having predictable diameters as well as other beneficial properties not found with prior methods. To prepare the fibers, the process contacts, in a zone having substantially laminar flow, a precipitation-acid stream and a acid-dope stream containing cellulose diacetate. As discussed below, the acid-dope stream is annularly disposed within and flows in the same direction as the precipitation-acid stream under conditions that result in substantial laminar flow. Cellulose diacetate is soluble in concentrated acetic acid solutions (e.g., acid dope) but loses solubility as the acetic acid concentration decreases. The precipitation acid is a low concentration acetic acid solution. Contacting the two streams in this manner causes a clear zone without obvious precipitation of cellulose diacetate fibers to be present as the two streams diffuse together decreasing the acetic acid concentration and allows the fibers to precipitate downstream from the contact point. The precipitated cellulose diacetate fibers may be collected using techniques known in the art such as filtration in a filter tank or on belt filter.

The precipitation-acid stream contains about 25 to about 35 percent by weight acetic acid and about 75 to about 65 percent by weight water. More preferably, this stream contains about 27 to about 33 weight percent acetic acid and about 73 to about 67 weight percent water, and most preferably about 29 to about 31 acetic acid and about 71 to about 69 water. The stream temperature ranges from about 100° F. to about 200° F., preferably about 125° F. to about 175° F., and most preferably about 135° F. to about 165° F.

The acid-dope stream contains about 5 to about 22 weight percent of cellulose diacetate and about 95 to about 78 percent by weight of a mixture of about 65 to about 90 weight percent acetic acid and about 35 to about 10 weight percent water. The cellulose diacetate is soluble in the concentrated acetic acid/water mixture. In a preferred embodiment, the acid-dope stream is produced directly from the hydrolysis step of a cellulose acetylation/hydrolysis process.

The acid-dope stream may preferably contain about 8 to about 16 weight percent cellulose diacetate and about 92 to about 84 weight percent of the acetic acid/water mixture, and more preferably about 8 to about 13 weight percent cellulose diacetate and about 92 to about 87 weight percent aqueous acetic acid. The acetic acid/water mixture may vary from about 70 to about 90 weight percent acetic acid, more preferably about 75 to about 85 weight percent, with the balance being water. As the preferred acid-dope stream comes directly from a cellulose acetylation/hydrolysis process, the acid-dope stream may contain other components remaining from that process.

The weight ratio of the precipitation-acid stream to the acid-dope stream is at least 9:1. Enough precipitation-acid must be used to precipitate the cellulose diacetate when the precipitation-acid stream and the acid-dope stream diffuse together. The resulting stream should have a low enough acetic acid concentration to precipitate the cellulose diacetate. The final acetic acid should not be so high as to partially solubilize the cellulose diacetate interfering with the cellulose diacetate fiber precipitation. In other words, the amount of precipitation-acid stream used depends upon the acid concentration of that stream, the acid concentration and amount of the acid-dope stream, and the desired acid concentration of the stream resulting from the precipitation-acid stream and the acid-dope stream diffusing together. As discussed, the final acid concentration should be such as to precipitate the cellulose diacetate.

As is known in the art, cellulose diacetate is sparingly soluble in relatively dilute acetic acid solutions with acid concentrations, for example less than 35% by weight. Such an acetic acid concentration in the resulting stream is generally sufficient for precipitation. Thus, enough precipitation acid should be used to achieve a resulting acid concentration where the cellulose acetate precipitates. In a preferred embodiment, the acetic acid may recovered and recycled after isolating the cellulose acetate fibers. Preferably then the acetic acid concentration in the resulting stream should be high enough to permit economical recovery using known techniques.

The cellulose diacetate preferably has an inherent viscosity (I.V.) of at least 1.0 measured in acetone when extrapolated to zero concentration of cellulose diacetate in acetone. More preferably, the inherent viscosity ranges from about 1.0 to about 1.6 and most preferably from about 1.2 to about 1.5. Accordingly, the process of the invention may be practiced with typical cellulose diacetates (or secondary cellulose acetates) and a wide range of intrinsic viscosities.

In a process according to the invention, the precipitation-acid stream has a linear flow greater than or equal to the linear flow of the acid-dope stream. Preferably, the linear flow rate of the precipitation-acid stream is slightly greater, e.g., about 10%, than the flow rate of the acid-dope stream. The streams are flowed together with the acid-dope stream annularly disposed within the precipitation-acid stream. As shown in FIG. 1 this may be accomplished by extruding an acid-dope stream within a flowing precipitation acid stream. This allows the precipitation-acid stream to preferably draw out the extruded acid-dope stream.

The precipitation-acid stream and the acid-dope stream are contacted in a zone having substantially laminar flow. In other words, the streams are contacted in the substantial absence of turbulence. Laminar flow is characterized by the gliding of concentric cylindrical layers past one another in an orderly fashion. In the present invention, substantial laminar flow is achieved with the annular disposition of the acid-dope stream within the precipitation-acid stream and the relative flows. Having substantially laminar flow, (eliminating turbulence at the contact point between the two streams), allows cellulose acetate fibers to precipitate in an orderly manner as the streams flow and diffuse together.

Preferably, the laminar flow between the streams should have a Reynolds number less than 3000 and more preferably, the Reynolds number should be less than 2000. Reynolds numbers provide a measure of the ratio between the dynamic forces of mass flow to the shear stress due to viscosity. A stream is considered turbulent if its Reynolds number is greater than 4000.

The temperature of both the precipitation-acid stream and the acid-dope stream should range from about 100° to 200° F. Preferably, the temperatures of each stream are about the same, though the temperature of the acid-dope stream may preferably be less than that of the precipitation-acid stream. Preferred ranges for the temperature of both streams is about 100° to 160° F. Where the acid-dope stream comes directly from a cellulose acetate process, the stream may be used at its present temperature with the precipitation-acid stream heated or cooled to nearly match in temperature. Alternatively, either stream may be heated or cooled to nearly match the other's temperature. The temperature the streams should be maintained as they flow through from the point of contact through the area where the cellulose acetate precipitates.

Under these substantially laminar flow and temperature conditions, precipitation of the cellulose diacetate occurs due to the diffusion together of the precipitation-acid stream and the dope-acid stream. The cellulose diacetate is soluble in the dope-acid with its high acetic acid content. As the two streams flow along and diffuse together, the acetic acid concentration decreases causing the cellulose acetate to precipitate. The clear zone results from the laminar flow of the two streams from the point of contact until sufficient diffusion occurs and the cellulose diacetate precipitates. The equilibrium acetic acid concentration in the combined stream should be low enough to promote full cellulose diacetate precipitation. The equilibrium acetic acid concentration should be less than 35 weight percent, and about preferably 30% or less by weight.

The precipitated cellulose diacetate may be collected, separated, and washed using techniques known in the art. For example, the stream containing the precipitated cellulose diacetate fibers may be collected in a filter tank. The fibers may then be washed with water to remove any acid, and dried in air or with heating. The stream may alternatively be flowed onto a belt filter having a moving screen to collect the precipitated cellulose diacetate fibers. Suction may be applied to remove any liquid from the fibers. The fibers may be sprayed with water, which may also be removed by suction, to wash away any remaining acid. The washed fibers may then be dried, again with known techniques such as air drying or heated drying.

As shown in FIG. 1, the dope-acid is preferably extruded into a stream of precipitation-acid flowing through a pipe. According to the invention, extruding the dope-acid into a precipitation-acid through an extrusion die having an orifice or a slit results in cellulose diacetate fibers as long as the contact occurs with laminar flow or substantial absence of turbulence, as described above.

Conventional precipitation processes extrude a cellulose diacetate-containing acid dope into a precipitation-acid solution through an orifice or a slit resulting in either in a rod or film. Without strongly agitating the precipitation-acid solution, the resulting rod has approximately the same diameter as the orifice. The rod may also be cut when pellet precipitation is desired. Similarly, the resulting film has approximately the same thickness and width as the slit unless the precipitation bath is strongly agitated to yield a flake precipitate.

According to the present invention, however, the cellulose diacetate-containing acid dope stream is contacted with a precipitation-acid stream through an orifice or slit in a zone of substantial laminar flow. This results in precipitation of small diameter individual strands of cellulose diacetate fibers unlike known precipitation processes. Fibers having the diameter of typical spun cellulose diacetate fiber (about 17–20 microns) have been produced according to the invention using a 0.0625 inch orifice. Assuming circular cross-section fibers, about 200 small fibers result when the expectation based on prior processes would be one large fiber.

FIG. 1 depicts an apparatus which may preferably be used to practice the present invention. The precipitation acid stream is delivered through a pipe, 10, through a feed housing, 11, to a precipitation chute, 12. Preferably, the precipitation-acid stream fills the precipitation chute, 11, before the acid-dope stream is introduced. As shown, the acid dope stream is delivered through a pipe, 20, equipped with a valve, 21, through the feed housing, 11, and a coupling, 22, to an extrusion die, 23. As shown, the acid-dope stream is extruded into a flowing precipitation-acid stream through the extrusion die 23 which is annularly disposed within the precipitation-acid stream.

Either pipe 10 or 20 may be fitted with valves or other control devices as is known in the art. Additionally, the entire apparatus or any portion of the apparatus may be heated or cooled using means known in the art in order to maintain the desired temperature of the streams and achieve cellulose diacetate fiber precipitation.

The precipitation chute 11 should be long enough such that precipitation of the cellulose diacetate fibers is essentially complete before the stream flows to a device or devices (not shown) to collect, separate, wash, and/or dry the fibers. Preferably, the precipitation chute should be longer than necessary to fully precipitate the cellulose diacetate fibers.

The type of extrusion die 23 is not critical. FIG. 2 shows various types of extrusion dyes which may be used. As shown, die A has 37 1/16" equally spaced holes, die B has 24 1/16" equally spaced holes, die C has 7 1/8" equally spaced holes, die D has 7 1/16" equally spaced holes, die E has a 1/8"×1" slit, die F has a 1/16"×1" slit, and die G has two aligned 1/8"×3/8" slits. The dope-acid may also be extruded through a pipe (or even a capillary-like tube) having substantially smaller diameter than the precipitation-acid stream pipe and extending farther into that stream than shown in FIG. 1. To avoid clogging of the dye or pipe during start-up or shut--down, a small amount of glacial acetic acid should preferably be extruded through the dye or pipe before and after the acid-dope stream.

Advantageously, the process of the present invention permits the production of small diameter cellulose diacetate fibers directly from the hydrolysis step in a cellulose acetate process. Accordingly, the process of the invention eliminates the need to dissolve the cellulose diacetate in a volatile solvent such as acetone followed by spinning or extruding the mixture to form fibers—a process that is very capital and labor intensive. The small diameter cellulose diacetate fibers prepared according to the invention have substantially the same relative diameter as filter tow filament or other cellulose diacetate fiber formed by conventional spinning techniques. Thus, the present invention represents a significant cost savings over current processes.

Advantageously, the process of the present invention allows one to control various properties of the cellulose diacetate fibers produced, particularly the fiber diameter. Parameters which have been found to effect the fiber properties include the water content in the acid dope, the temperature of the acid dope stream, the precipitation acid concentration, and the temperature of the precipitation-acid stream, and the intrinsic viscosity of the cellulose diacetate. Each parameter, with preferred values, is described above.

Successful practice of this invention lies not in a specific equipment design or configuration. Rather, the desired fibers are obtained by working within the parameters as described above and contacting the acid dope and the precipitation acid under conditions of substantial laminar flow. This allows diffusion of the streams together and precipitation of small diameter cellulose diacetate fibers.

Cellulose diacetate fibers produced according to the invention are less rigid and more curled than conventional fibers produced by conventional spinning and chopping procedures. The small diameter fibers also have a porous structure as compared to conventional spun fibers which are generally solid and more dense. The porous nature of the fibers allow them to absorbs plasticizers better than spun fibers. Accordingly, the present invention produces fibers which are more compatible with and easier to incorporate into cellulose sheets and which allow flat sheets to be readily prepared.

EXAMPLES

The following examples are intended to illustrate, not limit, the present invention.

Example 1

Cellulose diacetate fibers were prepared according to the invention using a 3"×4"×48" stainless steel trough. A cellulose diacetate acid dope (containing 16% cellulose diacetate Eastman CA-394--60S @1.6 I.V., 9.2% water and 74.8% acetic acid) was prepared in a 16 oz. PET soft drink bottle and heated to 160° F. About 35 lbs of precipitation acid (33% acetic acid, 67% water) in a stainless steel bucket was also heated to 160° F. When at temperature, the PET bottle was recapped with a cap across which had been sawed a 1/16" slit. Then while the precipitation acid was slowly poured down the trough, acid dope was extruded through the slit into the flowing precipitation acid. A continuous fibrous band similar in appearance to a filter tow band was formed. This continuous band flowed down the trough and into the collecting container. The bands of ester fibers were washed with water, cut into ¼" lengths and air dried. The collected material consisted of cellulose diacetate fibers with relative diameters between 1 and 4. One relative diameter is the diameter of a typical cellulose diacetate fiber, about 20 microns.

A mixture of the cut, dried fibers (2.7 wt. %), Prince Albert cellulose (68.1 wt %) and Aracruze Eucalyptus cellulose was prepared and refined to 250 Canadian Standard Freeness in a laboratory Valley Beater. Several 40 gram/meter hand sheets were prepared. Chemical analysis of the paper showed essentially quantitative retention of the cellulose diacetate fibers. This demonstrated the suitability of cellulose diacetate fibers prepared according to the invention for paper making.

Example 2

Several experiments were on a laboratory scale to identify the factors that affect the diameter of cellulose diacetate fibers prepared according to the invention. An acid dope of the proper composition was prepared by mixing cellulose diacetate (Eastman CA-394-60S, available from Eastman Chemical Co., Kingsport, Tenn.), glacial acetic acid and water in clean, dry 16 oz. PET soft drink bottles and heating the resulting acid dope to temperature in a water bath. For the precipitation acid, about 2500 ml of an acetic acid-water mixture was heated to temperature in a 3000 ml stainless steel beaker. A variable speed mixer was used to slowly stir the precipitation acid so there was liquid motion but a minimum of turbulence. The PET bottle cap had a 1/16" diameter hole through which the heated acid dope was extruded into the weak acid at a rate approximately matching that of motion of the liquid of the weak acid. The cellulose diacetate product from this scale experiment was a continuous filament or band of filaments.

The first experiment investigated the effect of the cellulose diacetate content in the dope acid, ("dope ester content"); the water content of the dope acid, ("dope water content"); the intrinsic viscosity of the cellulose diacetate in acetone, ("ester I.V."); the temperature of the acid-dope stream, ("dope temperature"); the temperature of the precipitation-acid stream, ("precipitation acid temperature"); and the acetic acid concentration in the precipitation acid, ("precipitation acid concentration"). A total of 52 experimental runs were made. The levels of variables studied are summarized in the following table:

| VARIABLE | LOW LEVEL | MID LEVEL | HIGH LEVEL |
|---|---|---|---|
| Dope Ester Content, % | 16 | 18 | 20 |
| Dope Water Content, % liquid | 11 | 21 | 31 |
| Cellulose Acetate IV | 1.39 | 1.53 | 1.60 |

-continued

| VARIABLE | LOW LEVEL | MID LEVEL | HIGH LEVEL |
|---|---|---|---|
| Dope Temperature, °F. | 120 | 140 | 160 |
| Precipitation Acid Temperature, °F. | 100 | 130 | 160 |
| Precipitation Acid Concentration, % | 25 | 30 | 35 |

Commonly accepted statistical experimental design practices were used in the planning and analysis of this set of experimental runs. Data analysis showed that for these 6 variables at the levels chosen for the experiment, only 4 (dope water content, dope temperature, precipitation acid temperature and precipitation acid concentration) had statistically significant effects on the diameter of the fibers. The factor having the largest effect was precipitation acid concentration. The largest probability of making fibers the size of a typical spun cellulose fiber (about 20 microns) would occur with the following conditions:

Precipitation acid concentration=35%

Precipitation acid temperature=160° F.

Dope water content=11%

Dope temperature=160° F.

Evaluation of the above results led to a second of experiments because of the following:

1. Use of precipitation acid at 35% concentration would result in economically unacceptable losses of cellulose acetate because of solubility considerations. For the second set of experiments, precipitation acid concentration would be fixed at 30%—a level that balances the economies of soluble losses versus the need for high acid strengths in acid recovery operations.

2. Since the viscosity gradient between two streams is important in determining the diffusion rate between them, it was surprising that neither ester I.V. nor dope ester content were important in this process because these two variables are important in determining dope viscosity. It was hypothesized that this may have been because the experimental range for each variable in the above experiment was small. The ranges in the second experiment were made much larger.

The variables and ranges for the second experiment are shown in the following table.

| VARIABLE | LOW LEVEL | MID LEVEL | HIGH LEVEL |
|---|---|---|---|
| Dope Ester Content, % | 8 | 12 | 16 |
| Dope Water Content, % liquid | 11 | 20.5 | 30 |
| Cellulose Acetate IV | 1.04 | 1.26 | 1.53 |
| Dope Temperature, °F. | 110 | 130 | 150 |
| Precipitation Acid Temperature, °F. | 100 | 130 | 160 |
| Precipitation Acid Concentration, % | 30 | 30 | 30 |

As in the first experiment, commonly accepted statistical experimental design practices were used in the planning and analysis of this set of experimental runs. The experimental design was a 2 factorial, replicated once, with 6 center points. A total of 38 specially planned experiments were performed.

The analysis of the experimental results showed that the level of each variable is important in determining the diameter of the resulting fibers. The mathematical model for the diameter of the fibers that resulted form this experiment was very complex in that it contained not only the main variables but also 4 interaction terms:

Dope Ester content×Precipitation acid temperature

Dope Water content×Precipitation acid temperature

Dope Ester content×Dope Water content

Ester I.V.×Dope temperature

An interaction term (for example, Dope Ester Content× Dope Water Content) indicates that at low Dope solids content, the effect of dope water content on fiber diameter is not important. But, at high dope solids content, the effect of dope water content on fiber diameter is important with low water content dopes making more preferred smaller diameter fibers.

The mathematical model derived from the experimental data was:

| | |
|---|---|
| Fiber diameter(microns) = 0.531*V4 − 2.619*V5 − 2.181*V2*V5 + | [3.868 + 0.625*V1 + 2.644*V2 − 1.838*V3 − 1.388*V2*V3 + 1.163*V1*V4 − 1.500*V3*V5] * 20 |

where:

V1=(ester I.V.−1.26)/0.27

V2=(dope ester content −12)/4

V3=(20.5−dope water content)/9.5

V4=(dope temperature−130)/20

V5=(precipitation acid temperature−130)/30

This mathematical model had a correlation coefficient of 0.87.

Because of the complexity of the physical process occurring during the preparation of cellulose acetate fibers according to the invention, this mathematical model permits one to identify the combination of conditions needed to make the desired product (diameter about 20 microns). Practical and/or economic considerations may require that some parameters be fixed to a small region. The model allows one to fix certain parameters and then trial and error and/or response surface techniques will yield optimum values for the remaining parameters. This, then, provides a powerful tool for designing and operating a manufacturing process for cellulose diacetate fibers according to the invention.

On the other hand, the model demonstrates the difficulty encountered when a question such as "what is the preferred dope cellulose diacetate content for the invention" is asked. Similar questions may be asked of each variable. To answer this, one needs to know what are the conditions specified for the other 4 variables. The exercise becomes a table with a LARGE number of statements such as:

if the Precipitation Acid Concentration is AAAA, the Dope Water content is BBBB, the Dope Temperature is CCCC, the Ester I.V. is DDDD, THEN and only THEN must the Dope Ester content be in the range of EEEE to FFFF so that the diameter of fiber will be in the desired range of GGGG to HHHH microns.

Example 3

Figure 3:
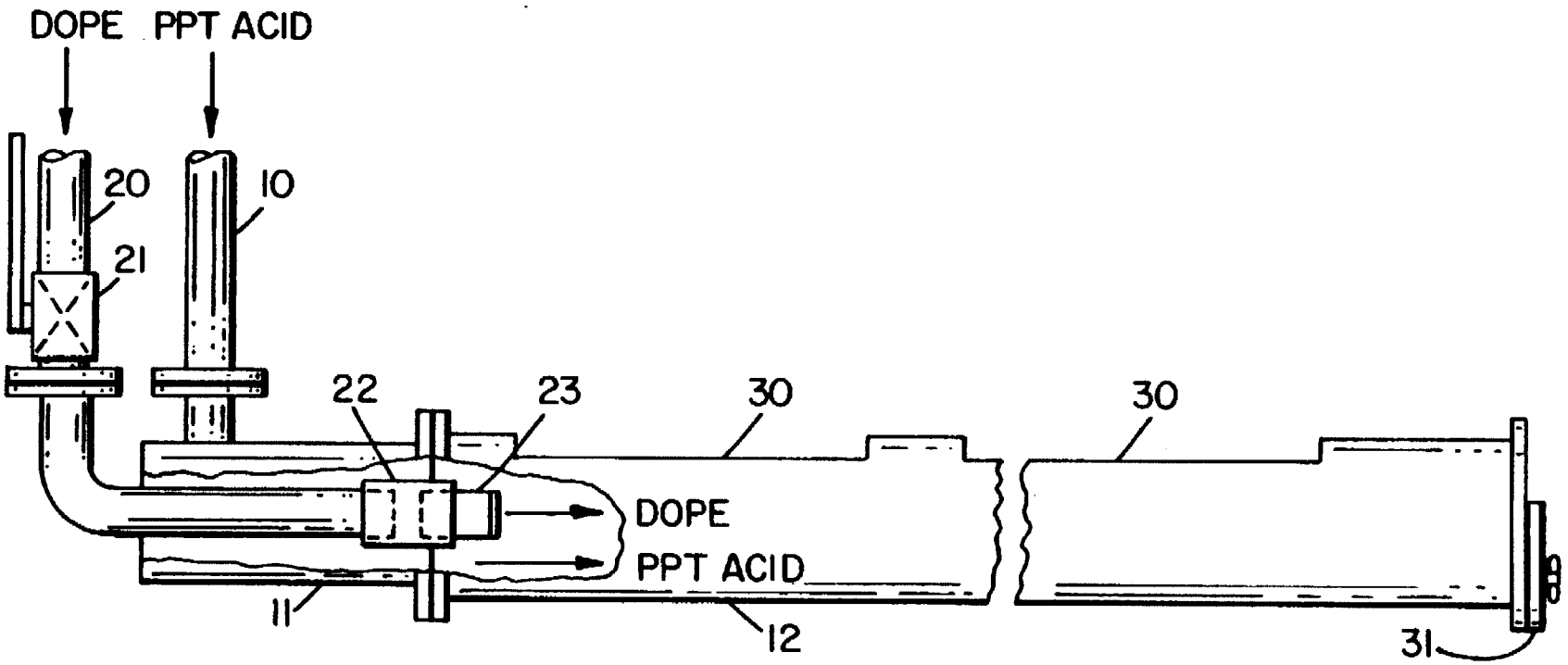
FIG. 3 depicts a pilot plant apparatus for carrying out a laminar flow process to prepare cellulose diacetate fibers according to the invention.

A drawing of pilot plant scale precipitation equipment used in scaling up this invention is shown in FIG. 3. The equipment is the same as that and depicted in FIG. 1 except that cut-away slots 30 were made to observe the cellulose diacetate fiber precipitation. A weir 31 was also added to adjust the liquid level in the precipitation chute 23. This could serve as the prototypical commercial unit. One inch pipes 10 carry the dope and precipitation liquid into a three inch diameter 18 foot long precipitation chute 23. The equipment was mounted approximately in a horizontal plane because slots 30 were cut in the upper side of the chute 23 for observing the operation. Otherwise, the precipitation chute could be positioned so the dope and precipitation stream were flowing at any angle from horizontal up to vertical. To minimize turbulence at the precipitation point for this design, the dope pipe extended about 2 feet further into the chute than did the precipitation acid pipe (not shown). Dope and precipitation acid were prepared in separate jacketed, stirred vessels.

Several runs were made in the above described pilot unit. Dope was prepared for each of these runs by placing 250 lb of fully neutralized cellulose diacetate dope (16.3% ester, 73.5% acetic acid, 9.2% water and 1.0% magnesium-sodium sulfate salts) into a stirred jacketed vessel. To this was added 250 lb acetic acid-water mixture (88.8% acetic acid, 11.2% water) for dilution and the resulting mix was heated to temperature. A total of 7000 lb of precipitation acid was prepared in other stirred jacketed vessels by mixing acetic acid and water in the proper proportions. See the table below for temperatures, precipitation (ppt) concentrations, dies and flow rates used for each run.

| BATCH NO. | ACID DOPE TEMP, °F. | PPT. ACID TEMP, °F. | PPT. ACID CONC., % | DIE USED | DOPE RATE, lb/min | PPT. ACID RATE, lb/min |
|---|---|---|---|---|---|---|
| 1 | 130 | 130 | 28 | *A | 5 | 80 |
| 2 | " | " | 30 | " | " | " |
| 3 | 140 | 140 | " | " | " | " |
| 4 | " | " | " | *B | " | " |
| 5 | " | " | " | " | " | " |
| 6 | " | " | " | " | " | " |
| 7 | " | " | " | " | " | " |
| 8 | 150 | 150 | " | " | " | " |
| 9 | " | " | " | *A | " | " |
| 10 | " | " | " | " | " | " |
| 11 | " | " | " | " | " | " |
| 12 | " | " | " | " | " | " |
| 13 | " | " | " | " | " | " |
| 14 | " | " | " | " | " | " |
| 15 | " | " | " | " | " | " |
| 16 | " | " | " | " | " | " |

*A = 7 × 1/16" equally spaced holes
*B = 2 × 1/16" × 3/8" slits

The changes in temperatures and dies were caused by the observation of dope flow out of the die. The *A die holes were plugging or partially plugging during runs 1–3 forcing the acid-dope stream to be extruded very rapidly through the remaining holes and the product fibers were more curved than the straight fibers expected form the laboratory experiments. The *B die allowed a more uniform acid-dope flow. Increasing the temperatures to 150° F. allowed the *A die to be used without having a hole plugging problem.

During several runs, the height of the weir and the slope of the trough were adjusted so that the acid dope could be extruded into air or under the flowing precipitation acid. No differences in the product form could be attributed to these changes. Throughout most of the runs, however, the acid dope was extruded under the flowing precipitation acid.

The product, although a small diameter fiber, was not a continuous filament as expected from the laboratory experience. This is believed to be due to the fact that the flow in the precipitation trough is more turbulent than that observed in the laboratory. A design to minimize that turbulent action would result in a longer filament.

After precipitation, the fiber-acetic acid-water slurry was placed in a false bottom tank and the precipitated acid was drained to recovery. The remaining fibers were washed with deionized water until free from acetic acid. After washing, 180 gm of magnesium carbonate was added to neutralize any combined sulfuric acid remaining from the cellulose acetylation/hydrolysis production process and the fibers separated form the liquid via centrifugation in a basket centrifuge. The product was stored in a plastic bag lined fiber drums.

Forty gm/m$^2$ hand sheets from each sample were made by mixing them 50—50 with 70%–30% blend of softwood-hardwood pulp. The mix was refined to a target freeness before the hand sheets were made. During this work, the observation was made that the amount of refining time to reach the target freeness varied greatly between samples. As a result, the time for each sample to refine to 350 CSF freeness was determined.

The products from the carious runs were combined into two roughly equal sized lots based on refining time reached 350 CSF. The results are shown in the following table.

| Batch No. | BONE DRY WEIGHT, lbs. | REFINING TIME TO 350 CSF in VALLEY BEATER, min. |
|---|---|---|
| | LOT #1 | |
| 1 | 21.6 | 21 |
| 2 | 28.0 | 22 |
| 4 | 21.0 | N.A. |
| 6 | 26.2 | 17 |
| 7 | 24.0 | 19 |
| 8 | 34.9 | 21 |
| 9 | 24.0 | 21 |
| 11 | 30.0 | 19 |
| | LOT #2 | |
| 3 | 24.9 | 25 |
| 5 | 24.6 | 21.5 |
| 10 | 29.2 | 24 |
| 12 | 32.0 | 45 |
| 13 | 34.7 | 34 |
| 14 | 26.4 | 42 |
| 15 | 27.8 | 43.5 |
| 16 | 33.2 | 35 |

These two lots of fibrous cellulose diacetate were taken to the Herty Foundation in Savannah, Ga. and were used to make paper with normal paper making equipment. Four experiments were run with the cellulose diacetate fibers. One control run (pulp only) was also run. All papers were targeted for 45 lb/3000 ft$^2$ basis weight. The pulp used was Albacel soft wood. The cellulose diacetate fiber prepared according to the invention was used with it in a 50—50 ratio. Each experimental run and the control contained Hercon (2.5 lb/ton), Kymene (0.3%) and Stalok (7.5 lb/ton). The control (pulp only) was refined to 350 CSF freeness while the experimental material was refined to either 350 or 500 CSF freeness. The results are shown in the following table.

| Run # | A | B | C | D | E |
|---|---|---|---|---|---|
| Nominal fiber content, % | 0 (control) | 50 | 50 | 50 | 50 |
| LOT # | N.A. | 1 | 1 | 2 | 2 |
| Refining freeness CSF | 350 | 500 | 350 | 500 | 350 |
| Basis wt., AD g/m$^2$ | 75.82 | 78.49 | 75.41 | 76.69 | 74.98 |

-continued

| Run # | A | B | C | D | E |
|---|---|---|---|---|---|
| Moisture % | 5.89 | 5.89 | 5.89 | 5.89 | 5.89 |
| Caliper, mm/sheet | 0.14 | 0.18 | 0.17 | 0.19 | 0.18 |
| Apparent density, g/cc | 0.552 | 0.431 | 0.433 | 0.407 | 0.418 |
| Bulk, cc/g | 1.81 | 2.32 | 2.31 | 2.45 | 2.40 |
| Tensile av., kN/m MD | 6.03 | 2.69 | 2.72 | 2.30 | 2.41 |
| Tensile av., Kn/m CD | 2.01 | 0.88 | 0.85 | 0.83 | 0.89 |
| Breaking length, Km MD | 8.107 | 3.497 | 3.685 | 3.057 | 3.281 |
| Breaking length, Km CD | 2.704 | 1.145 | 1.151 | 1.099 | 1.215 |
| Tensile index, N*m/g MD | 79.48 | 34.28 | 36.13 | 29.97 | 32.17 |
| Tensile index, N*m/g CD | 26.51 | 11.23 | 11.29 | 10.77 | 11.91 |
| Tensile ratio, MD/CD | 3.00 | 3.05 | 3.20 | 2.78 | 2.70 |
| Stretch av., % MD | 2.48 | 2.36 | 2.30 | 2.58 | 2.11 |
| Stretch av., % CD | 7.38 | 5.96 | 5.52 | 6.10 | 5.50 |
| Tear av, Mn CD | 1147.8 | 1024.2 | 996.7 | 1020.2 | 884.9 |
| Tear Index, Nm* m2/g CD | 15.14 | 13.05 | 13.22 | 13.30 | 11.80 |
| Folding endur. av, 1 kg, MIT Tester CD | 1204.3 | 58.6 | 89.6 | 41.7 | 56.6 |
| Folding endur. av, 1 kg, MIT Tester CD | 524.1 | 7.3 | 9.1 | 6.4 | 8.4 |
| Porosity Sheff.-orifice | 1.5" orif. | 3/4" orif. | 1.5" orif. | 1.5" orif. | 1.5" orif. |
| Porosity Scheff.-orifice | 2261 | 694 | 1944 | 3239 | 2186 |
| Smoothness Scheff. SCCM top-side | 3396 | 3442 | 3425 | 3469 | 3442 |
| Smoothness Scheff. SCCM wire-side | 3308 | 3367 | 3317 | 3371 | 3302 |
| Taber stiff Nm.m | 0.30 | 0.18 | 0.16 | 0.16 | 0.18 |
| Actual fiber content % | N.A | 43.5 | 44.0 | 47.2 | 46.8 |

There was no problem in handling lot 1 or lot 2 in stock preparation, refining or pumping. The cellulose diacetate fibers appeared to disperse well in the wet end machine system. The only significant quality issues seen during cursory paper examination were the presence of what appeared to be fiber "knits" in the sheet, possibly refining related, and "debris" on the sheet surface, something like small flake material in the cellulose diacetate fiber containing paper. Run A, the all cellulose control, ran very well but the formation was extremely lumpy. Formation for Run B was improved over Run A. The sheet for Run B appeared significantly wetter at the couch and press sections than that for Run A. Observations for Runs C–E were the same as for Run B.

The invention claimed is:

1. A process for preparing cellulose diacetate fibers comprising contacting in a zone having a substantially laminar flow wherein the Reynold's number is less than 3000

(A) a precipitation-acid stream having a temperature of 100° to 200° F. and comprised of 25 to 35 percent by weight acetic acid and 75 to 65 percent by weight water, and (B) an acid-dope stream annularly disposed within and flowing in the same direction as the precipitation-acid stream, the acid-dope stream having a temperature in the range of 100° to 200° F. and comprised of 5 to 22 weight percent of cellulose diacetate having an inherent viscosity of at least 1.0, and 95 to 78 percent by weight of a mixture comprising 65 to 90 weight percent acetic acid and 35 to 10 weight percent water, wherein the precipitation-acid stream has a linear flow greater than or equal to the linear flow of the acid-dope stream and the weight ratio of the precipitation-acid stream to the acid-dope stream is at least 9:1.

2. The process of claim 1 wherein the precipitation-acid stream comprises 30 percent by weight acetic acid and 70 percent by weight water.

3. The process of claim 1 wherein the ratio of flow rate between the precipitation-acid stream and the acid-dope stream is greater than 10:1.

4. The process of claim 1 wherein the contacting step comprises extruding the acid-dope stream into the precipitation-acid stream.

* * * * *